US005803838A

United States Patent [19]

DeMarini et al.

[11] Patent Number: 5,803,838

[45] Date of Patent: Sep. 8, 1998

[54] DROGUE FOR SPORT BATS AND CLUBS

[75] Inventors: Raymond DeMarini, Hillsboro, Oreg.; Troy Loney, Mount Holly, N.J.

[73] Assignee: DeMarini Sports, Inc., Hillsboro, Oreg.

[21] Appl. No.: 612,641

[22] Filed: Mar. 8, 1996

[51] Int. Cl.[6] ..... A63B 69/00

[52] U.S. Cl. ..... 473/437; 473/457; 473/228; 244/142

[58] Field of Search ..... 473/457, 228, 473/437, 422; 273/199 A; 244/142; 482/74, 111

[56] References Cited

U.S. PATENT DOCUMENTS

| | | | |
|---|---|---|---|
| 3,416,803 | 12/1968 | Batista | 473/228 |
| 4,907,800 | 3/1990 | Passamaneck et al. | 473/457 |
| 5,207,625 | 5/1993 | White | 473/457 |

FOREIGN PATENT DOCUMENTS

| | | | |
|---|---|---|---|
| 2093706 | 9/1982 | United Kingdom | 273/199 A |

OTHER PUBLICATIONS

Statement of Troy Loney, dated 4 Dec. 1996.

*Primary Examiner*—Mark S. Graham

*Attorney, Agent, or Firm*—Klarquist Sparkman Campbell Leigh & Whinston, LLP

[57] ABSTRACT

A drogue chute for increasing aerodynamic resistance against the movement of a swinging sport implement such as a bat, racket or club. The drogue includes a canopy that attaches to the sport implement by suspension lines. When the sport implement is swinging, the canopy inflates to create a relatively high aerodynamic drag. The drogue may also include a break-away fastener. When the fastener is connected, the canopy is reefed so that the drogue provides relative little aerodynamic drag to the sport implement. When the sport implement reaches a sufficient speed, the fastener disconnects allowing the canopy to inflate thereby providing a sudden increase in aerodynamic resistance.

12 Claims, 2 Drawing Sheets

53
18b
40
30
42
18
44
46
48
34
22b
34
30
20b
32
22
50
14
20
38
16
18
20
20b
20a
22a
24
54
37
36
10
26
28
12

37
36
40
18b
18
44
18a
34
30
42
16b
50
32
22
48
18
16
16a
14
38
24
26
10
28
34
18b
20

DROGUE FOR SPORT BATS AND CLUBS

FIELD OF THE INVENTION

The present invention pertains to an apparatus for providing resistance to the swinging of sports implements such as bats, clubs, and rackets.

BACKGROUND OF THE INVENTION

In baseball and softball, power is important to batting performance. Particularly important, is the batter's power at ball impact. Greater power means the ball can be hit further.

To improve batting power, players can swing an unweighted, ordinary bat or a weighted bat. Weighted bats are more effective for improving batting power because greater force is required to accelerate the bat. Such weighted bats may be specially constructed solely to permit players to practice their swing or warm up. Alternatively, one or more donut-shaped weights can be removably mounted on an ordinary bat for these purposes.

However, weighted bats have drawbacks because their larger mass adds downward gravitational force that is not present in ordinary bats. Such downward force may feel unnatural to a batter and adversely effect the batter's batting form. Excessive weighting of the bat may even harmfully strain a player. Moreover, as with an unweighted bat, swinging a weighted bat does not simulate the impact of the bat against a ball. Thus, there is a need for a training device that builds a batter's swinging power and simulates an unweighted bat striking a ball.

SUMMARY OF THE INVENTION

The present invention is a drogue chute that attaches to a sport implement (i.e., a bat, club or racket) such that by swinging the implement, the chute inflates to provide aerodynamic drag on the sport implement without adding significant downward force associated with weighted bats. Additionally, in a preferred embodiment, the drogue can be reefed so that the drogue unreefs when the implement is swung with sufficient speed to allow the chute to open suddenly to simulate the impact of the implement against an object such as a ball.

In a preferred embodiment the drogue includes a canopy and suspension lines attached to a sleeve that is fitted onto a bat. During bat swing, the canopy inflates to substantially increase aerodynamic drag on the bat. A center line may be used to connect to a central portion of the canopy to increase aerodynamic drag of the inflated canopy. Additionally, a reef tape having a break-away fastener may be used to reef the canopy so that it has low aerodynamic drag. When the bat is swung with sufficient speed the fastener breaks away thus unreefing the canopy so that it can inflate suddenly into a high aerodynamic drag configuration to simulate an impact of the bat and a ball. Preferably, the functions of the center line and the reef tape are combined as a single tape that extends between a central portion of the canopy and the sleeve.

BRIEF DESCRIPTION OF THE DRAWINGS

FIGS. 3*a*, 3*b*, and 3*c* are top plan views of the drogue of FIG. 1 at various positions during a practice swing of the ball bat.

DETAILED DESCRIPTION OF THE PREFERRED EMBODIMENTS

Figure 1:
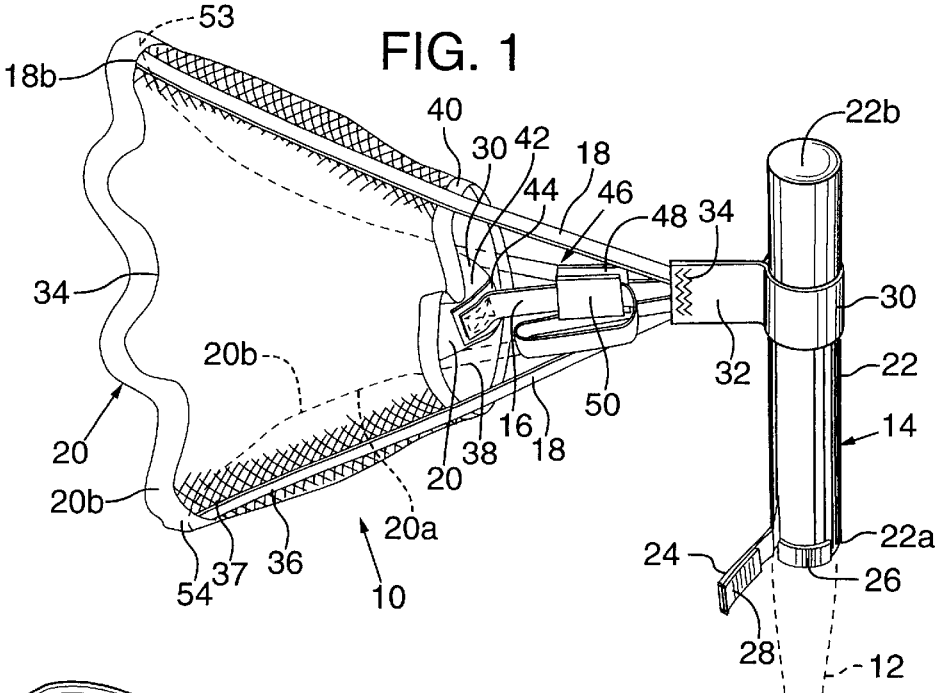
FIG. 1 is a perspective view of a preferred embodiment of a drogue chute of the present invention in a reefed configuration and attached to a bat shown in phantom.
Figure 2:
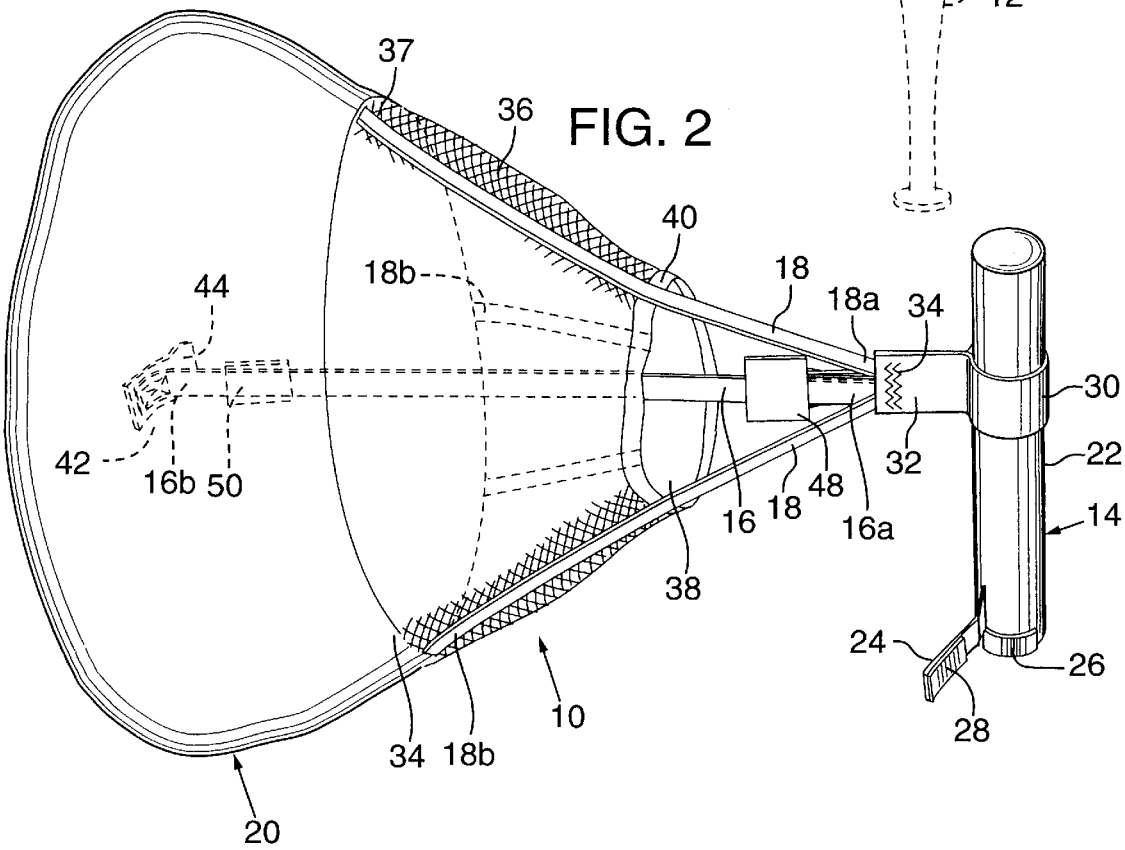
FIG. 2 is a perspective view of the drogue of FIG. 1, showing the drogue in an open, or inflated, configuration.

FIGS. 1 and 2 show a drogue 10 in accordance with one embodiment of the present invention. The figures and description refer primarily to use of the drogue with ball bats, but the present invention also may be applied to golf clubs, tennis rackets, and other sports implements. In FIG. 1 the drogue 10 is attached to a ball bat 12 (shown in phantom).

An overview of the operation of the present invention will assist in understanding the detailed description. Briefly, the drogue can be attached to a bat and reefed so that it has low aerodynamic resistance. The bat, and drogue are swung, increasing speed throughout the swing. When the bat and drogue reach sufficient speed, the drogue will suddenly unreef and inflate, thus substantially increasing aerodynamic resistance. It is the sudden increase in aerodynamic resistance that simulates bat-ball impact.

An alternative use for the drogue is as an aerodynamic decelerator whereby the drogue is attached to a bat in its unreefed configuration and the bat is swung back and forth. This training method provides a bat with a large resistance to swinging but no substantial extra downward force. Training with the drogue of the present invention is believed to improve a batter's power.

The drogue 10 can be configured as reefed (represented in FIG. 1) and "open," or inflated, (represented in FIG. 2). When reefed, the drogue is furled and provides little air resistance when pulled through the air. When inflated, the drogue produces maximum aerodynamic resistance.

The drogue 10 includes an attachment device 14, reef tape 16, suspension lines 18, and a canopy 20. The attachment device 14 couples to the bat 12 thus attaching the canopy 20 to the bat. The suspension lines 18 extend between the attachment device 14 and the canopy 20.

When coupling to a bat, the preferred embodiment of the attachment device 14 is a sleeve 22 with an open end 22*a* and a closed end 22*b*. The sleeve fits over a large diameter end of the bat 12. A cinch strap 24, near the open end of the sleeve 22 tightens over a tapered portion of the bat to secure the sleeve to the bat. Preferably, the cinch strap 24 is a hook and pile fastener 26 for ease in donning and doffing the sleeve.

The sleeve 22 is preferably made of nylon fabric and is sized to fit a variety of bat diameters satisfactorily. To improve the fit of the sleeve over bats of various diameters, the sleeve may also be provided with additional cinch members (not shown) along the length of the sleeve. It is also contemplated that sleeves of different diameters may be offered to custom fit particular bats. Also, the sleeve may be fabricated of an elastic material to fit snugly on a bat.

A nylon belt 30 encircles the sleeve 22 near the sleeve closed end 22*b*. The belt 30 includes distal belt ends 32 that overlap and extend radially from the sleeve 22. The suspension lines 18 include first ends 18*a* that are attached to the belt ends 32 and secured in place by stitches 34. The reef tape also includes a first end 16*a* that is attached to the belt ends 32.

The suspension lines 18 and reef tape 16 extend from the belt to the canopy 20. The canopy 20 is preferably a circular piece of nylon fabric having low air permeability. The canopy surface defines an inner surface 20*a* and an outer surface 20*b*.

Preferably, there are four suspension lines 18 that are stitched to the canopy at evenly spaced positions along a peripheral margin 34 of the canopy. The suspension lines 18 attach to the canopy 20 at their second ends 18*b*.

To prevent the canopy from becoming entangled with the suspension lines 18 (e.g., by inverting and passing between two adjacent suspension lines) air-permeable netting 36 extends circumferentially between the four suspension lines 18. The netting has a circular shape (when laid flat) with an outer margin 37 and a central, circular cutout defining an inner margin 38. The outer margin 37 is stitched to the canopy peripheral margin 34. The netting 36 is also stitched to the suspension lines 18. The inner margin 38 of the netting 36 is spaced about three and one-half inches from the belt 30 and a reinforcing nylon ribbon 40 is stitched along the inner margin 38.

The reef tape 16 extends from the belt 30 to a central portion 42 of the canopy 20. An end 16*b* of the reef tape is attached to a reinforcing patch 44 stitched to the canopy within the central portion 42.

In the reefed configuration shown in FIG. 1, a release device 46 acts to effectively shorten the length of the reef tape 16 in order to partially invaginate the canopy 20. The preferred release device 46 is a hook and pile fastener including a pile pad 48 connected to the reef tape 16 near the end 16*a*, and a hook pad 50 connected to the reef tape near the end 16*b*. Connecting the hook pad 50 to the pile pad 48 brings the reef tape ends 16*a*, 16*b* closer together, thus invaginating the central portion of the canopy, locating it substantially within the netting 36 between the suspension lines 18. Preferably, the pile pad 48 is easily replaceable because the pads can wear out with use.

When the canopy is reefed (FIG. 1), all but an annular portion near the peripheral margin 34 of the canopy is invaginated. In other words, substantially the entire outer surface 20*b* of the canopy 20 faces radially inward only the canopy outer surface 20*b* along the peripheral margin 34 faces outward. The uninverted canopy peripheral margin 34 and an adjacent region of the inverted portion of the canopy form a generally annular trough 53 about the periphery of the closed canopy 20. During swinging of the bat 12, the trough 53 fills with air to assist with opening canopy 20.

The size of the trough affects the speed at which the release device will decouple. A larger trough will catch more air and create a large force in the reef tape. The size of the trough may be controlled by the location of the hook and pile pads, 50, 48. If the pads are near the reef tape ends 16*a*, 16*b*, the amount of invagination will be greater and the trough 53 will be smaller.

As shown in FIG. 2, unfastening the hook and pile pads 50, 48 permits the reef tape 16 to extend to its full length, permitting the canopy to inflate into its open configuration. When extended, the reef tape acts like a centerline on a parachute, and the length of the reef tape determines the inflated shape of the canopy 20. In the preferred embodiment, the reef tape restrains the center portion of the canopy so that the canopy has a shape similar to the surface of a tooth; that is, it has tapered sides and a slightly inverted "crown" at the center portion 42. A longer reef tape 16 would allow the center portion 42 to be less inverted, while a shorter reef tape would make the center portion more inverted. The inflated shape of the canopy 20 affects the aerodynamic drag of the drogue. A very long, or absent, reef tape 16 would allow the canopy to assume a substantially spherical shape having a certain coefficient of aerodynamic resistance. Pulling in the center portion 42 of the canopy 20 will increase the aerodynamic coefficient up to a maximum. Further shortening of the reef tape 16 will begin invaginating the canopy, thus reefing it, and the aerodynamic coefficient will decrease.

Operation

Figure 3B:
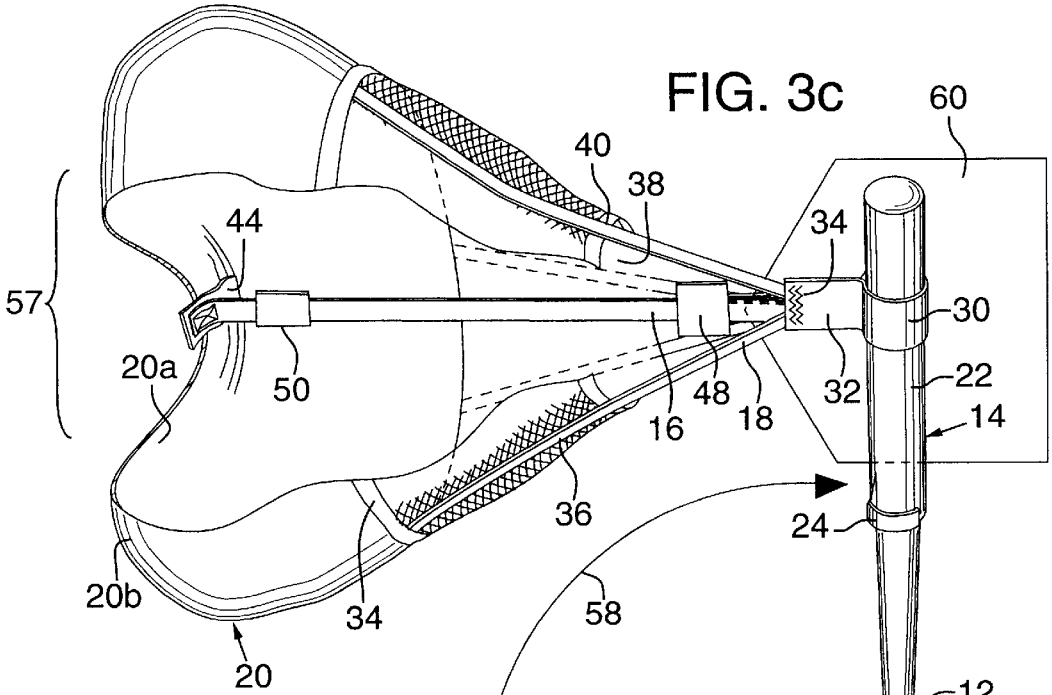
Figure 3B:
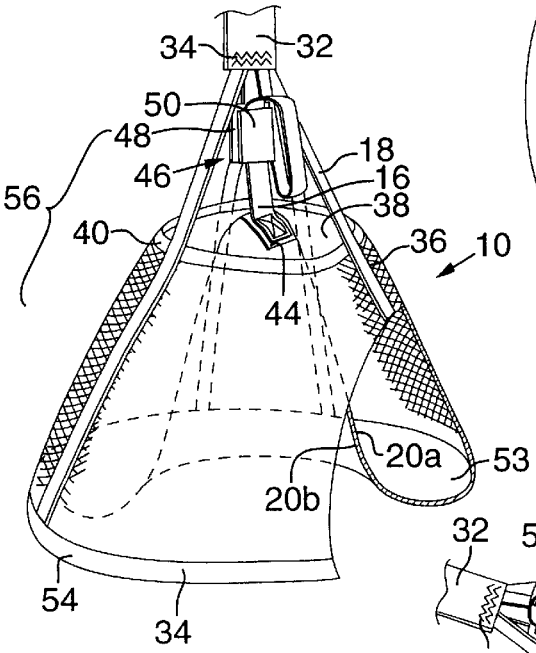
Figure 3A:
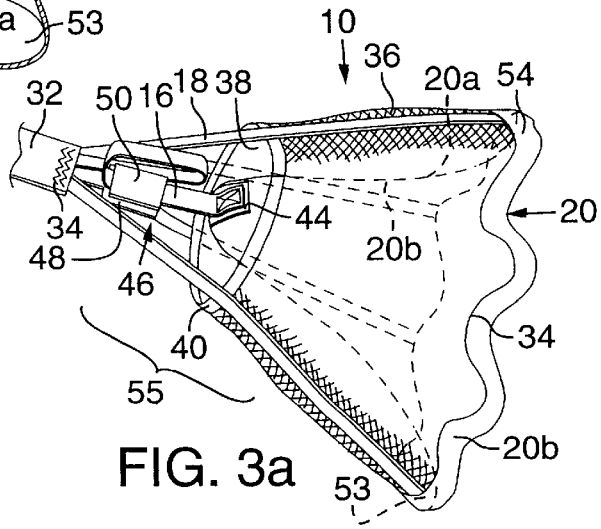

The operation of the drogue 10 is shown in FIGS. 3*a*–3*c*. In FIG. 3*a* the drogue is shown at an initial position 55 (just after the swing has started). In FIG. 3*b*, the drogue is shown at an intermediate position 56 in mid-swing. In FIG. 3*c* the bat and drogue are shown at an impact position 57 with the drogue fully inflated. These positions occur along a swing path 58. The impact position 57 is the position in the swing where impact with a ball would be expected. For ease of understanding, the impact position 57 is shown with reference to a "home plate" 60.

To use the drogue to simulate hitting a ball, a batter slides the sleeve 22 over the bat 12 and tightens the cinch strap 24. The release device hook pad 50 is then fastened to the pile pad 48 (FIG. 1) to place the canopy 20 in the reefed configuration. The bat is then ready for swinging.

Before the swing is initiated, the drogue hangs downwardly from the bat (not shown). Immediately after the swing is begun, as shown in FIG. 3*a* at position 55, the drogue swings upwardly to follow the bat 12 through the swing path 58. Due to its lightweight construction, the drogue adds negligible weight to the bat and accordingly does not produce any significant gravitational force that could adversely effect the batter's training.

In the initial swing position 55 (FIG. 3*a*), the reefed drogue provides relatively little air resistance. As the swing continues and bat speed increases, the trough 53 formed by the uninverted peripheral margin 34 rapidly fills with air to expand the invaginated portion of the canopy radially inward, as shown at position 56 (FIG. 3*b*). The resistance provided by the reefed canopy increases with bat speed, generating an increasing tensile force along the reef tape 16 which is transmitted across the coupled pile and hook pads 48, 50.

Sometime before impact position 57 (FIG. 3*c*), the bat speed reaches a threshold speed at which the resistance of the reefed canopy 20 generates a selected threshold tensile force on the reef tape 16 that detaches the hook pad 50 from the pile pad 48, thereby permitting the canopy 20 to inflate. The opening of the canopy, and the attendant increase in resistance, is quick, thus closely simulating impact with a ball. Furthermore, the resistance force generated by the opened canopy 20 is directed along the plane of the swing path 58, much like the resistance generated by an impact with a ball. The amount of resistance force can be increased or decreased by changing the length of the reef tape 16 as described above. The present embodiment has a reef tape with a fixed length; however, alternative embodiments may include an adjustable length reef tape. The nearly instantaneous increase in resistance has a natural feel, and is highly effective for improving a batter's power at ball impact without compromising batting style.

The canopy remains open through the follow-through portion of the swing (not shown) to build the batter's follow-through strength.

After the swing is complete, the batter may quickly prepare for another swing by attaching the release device hook pad 50 to the pile pad 48. In order to facilitate such reclosing of the drogue, the reef tape 16 may be made of red nylon to permit easy visual identification of the release device hook pad 50 and pile pad 48.

The present release device 46 also permits the batter to conveniently adjust the threshold tensile force (and thus the threshold speed of the bat) required for separating the hook and pile pads to permit inflation of the canopy 20. The batter may selectively mesh only portions of the pads or vary the pressure of the pad meshing, in order to selectively control the bat speed at which the canopy opens. In other words, the batter may adjust the sensitivity of the release device to customize the training.

An alternative operative mode is to simply swing the bat 12 back and forth with the drogue in the unreefed configuration. Because the drogue is lightweight, the downward force is inconsequential.

In a preferred embodiment the canopy 20 is formed from a 30 inch circular piece of nylon. The suspension lines are ⅜ inch nylon tape approximately 15 inches long. The reef tape 16 is a ½ inch nylon tape approximately 15 inches long.

Numerous additions, substitutions, and modifications to the above embodiment fall within the scope of the invention. For instance, materials such as plastic and cloth may also be used for various drogue components. Other fastening means such as heat welding, ultrasonic welding, and adhesives may be used to fasten together the drogue.

An alternative reef tape 16 may be an elastic cord, such as a bungee cord, that rapidly stretches at a selected tensile force. An elastic cord reef tape would produce a different feel than the nylon reef tape described above. The elastic reef tape would not provide the sudden lengthening of the reef associated with the quick decoupling of the hook and pile fastener.

In another alternative embodiment, the reef tape may be dispensed with by providing hook and pile pads that extend, respectively, from the opposing belt ends 32 to the canopy central portion 42. In such an embodiment, the hook and pile pads may be meshed together in the closed configuration to invert the canopy, and be detached as described above to permit the canopy to open. Without the reef tape, the canopy would have a more spherical shape in the open configuration and hence generate less aerodynamic drag.

This detailed description is set forth only for purposes of illustrating examples of the present invention and should not be considered to limit the scope of the invention in any way. Accordingly, the scope of the invention is defined by the appended claims and their equivalents.

What is claimed is:

1. A training system for increasing air resistance against the movement of a sport implement, comprising:

(a) a sport implement that can be used in a sport in which the implement is swung to strike an object; and (b) a inflatable canopy coupled to the sport implement and wherein motion of the sport implement inflates the canopy so that the canopy exerts aerodynamic drag on the sport implement when the sport implement is moving.

2. The training system of claim 1 wherein a plurality of suspension lines interconnect the canopy to the sport implement.

3. The training system of claim 2 wherein a mesh is attached across at least two of the suspension lines.

4. The training system of claim 1, further comprising a reef tape having a first end and a second end, the first end coupled to the sport implement and the second end coupled to a central portion of the canopy.

5. The training system of claim 4 wherein a portion of the reef tape proximate the first end is removably attached to a portion of the reef tape proximate the second end, thereby reefing the canopy.

6. The training system of claim 1 further comprising an attachment device coupled to the canopy for attaching the canopy to the sport implement.

7. The training system of claim 1 wherein the canopy includes a central portion and a periphery and further comprising a release device coupled to the central portion of the canopy and the sport implement thereby configuring the canopy in a reefed configuration having low aerodynamic drag and whereby the release device releases to permit the canopy to inflate into an open configuration having greater aerodynamic drag than the reefed configuration thereby increasing aerodynamic resistance on the sport implement when the sport implement is moving.

8. The training system of claim 7, further comprising a reef tape having a first end and a second end, the first end coupled to the sport implement and the second end coupled to a central portion of the canopy, wherein the release device comprises a first portion located proximate the reef tape first end and a second portion located proximate the reef tape second end, the first portion releasably couplable to the second portion so that when the first portion is coupled to the second portion the canopy is secured in the reefed configuration and when the first portion is decoupled from the second portion the canopy is in the open configuration.

9. The training system of claim 8 wherein the first portion decouples from the second portion when the canopy applies a predetermined force on the reef tape.

10. The training system of claim 7 wherein the canopy in the reefed configuration is partially invaginated thereby defining a trough along an uninverted peripheral margin portion, wherein the trough fills with air to initiate the opening of the canopy when the sport implement moves through the air.

11. A method of training for a sport that uses a sport implement that is swung to strike an object, the method comprising the steps:

(a) attaching a drogue to a sport implement, the drogue comprising a canopy;

(b) swinging the sport implement to simulate a motion associated with a use of the sport implement during a sport for which the sport implement is intended, wherein swinging the sport implement inflates the drogue canopy so that the canopy exerts an aerodynamic resistance force on the sport implement.

12. The training method of claim 11 further comprising the step of reefing the canopy by coupling portions of a break-away fastener so that during the step of swinging the sport implement the break fastener decouples and the canopy inflates suddenly thereby simulating an impact force of the sport implement with an object.

* * * * *